US007954815B2

(12) United States Patent
Bober et al.

(10) Patent No.: US 7,954,815 B2
(45) Date of Patent: Jun. 7, 2011

(54) SEGMENTED RIGID PLATE BELT TRANSPORT WITH A HIGH MOTION QUALITY DRIVE MECHANISM

(75) Inventors: Henry T Bober, Fairport, NY (US); Frank A Porter, Penfield, NY (US); James L Giacobbi, Penfield, NY (US); Adam D Ledgerwood, Geneva, NY (US); Aaron M Moore, Rochester, NY (US); Kenneth P Moore, Rochester, NY (US); Gregory A Ludgate, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 80 days.

(21) Appl. No.: 12/488,607

(22) Filed: Jun. 22, 2009

(65) Prior Publication Data

US 2010/0320677 A1 Dec. 23, 2010

(51) Int. Cl.
*B65H 5/02* (2006.01)

(52) U.S. Cl. ..... 271/276; 198/833

(58) Field of Classification Search ..... 271/94, 271/194, 196, 197, 276; 198/833, 842, 689.1, 198/811

See application file for complete search history.

(56) References Cited

U.S. PATENT DOCUMENTS

| | | | | |
|---|---|---|---|---|
| 3,941,238 | A * | 3/1976 | Lapeyre | 198/811 |
| 5,305,869 | A * | 4/1994 | Damkjaer | 198/689.1 |
| 6,505,023 | B2 * | 1/2003 | Miyamoto | 399/237 |
| 6,505,030 | B1 | 1/2003 | Santiago et al. | |
| 6,868,747 | B2 * | 3/2005 | Goser et al. | 74/25 |
| 7,118,103 | B2 * | 10/2006 | Greive | 271/275 |
| 7,815,042 | B2 * | 10/2010 | Oishi | 198/837 |
| 2006/0054467 | A1 * | 3/2006 | Oishi | 198/835 |

* cited by examiner

*Primary Examiner* — Michael C McCullough

(57) ABSTRACT

A vacuum transport includes a segmented, rigid or solid articulated belt combined with a vacuum plenum in each segment of the belt. Using a rigid segmented belt with a vacuum plenum connected to each segmented belt section eliminates ordinarily encountered drag friction in conventional vacuum transports by reducing the force necessary to move the belt with media thereon while simultaneously improving the motion quality of the move by driving the articulated rigid belt from the top side of the belt in a flat section.

18 Claims, 7 Drawing Sheets

SEGMENTED RIGID PLATE BELT TRANSPORT WITH A HIGH MOTION QUALITY DRIVE MECHANISM

This disclosure relates to a printing apparatus, and more specifically, to an improved rigid plate belt and drive system for use in an ink jet printing apparatus.

Typically, vacuum transport systems are disposed within a copier or printer between a photoreceptor and the fuser rolls and comprises a flexible belt which is entrained about two or more rollers. This belt typically includes a number of small holes therein. Disposed inside the belt is a vacuum plenum having a slotted plenum plate thereover with the vacuum plenum being actuated by a vacuum blower to thereby draw air through the holes in the belt, particularly in the area where a sheet moving in a process direction is passing over the belt. Thus, the vacuum plenum holds a sheet against the outer surface of the belt while the belt moves the sheet, for example, from the photoreceptor toward the nip of the fuser rolls. For traditional vacuum transport implementations increasing cut sheet media sizes can cause decreased air flow losses and increasing static vacuum pressures on the sheet and belt acting against the stationary plenum plate. This causes non-useful high friction between the belt and the slotted plenum plate. This arrangement also has the added problem of keeping the moving holes of the belt always exposed to the rigid plenum slots. Additionally, the requirement for a consistent flat belt that is consistently flat under all the print heads of an ink jet printing system is a problem with tight specifications.

In U.S. Pat. No. 6,505,030 a vacuum transport is shown that allows for varying air pressure on a sheet responsible to sensed sheet parameters, such as, weight and size with the use of multiple plates in a vacuum plenum and a sensor. This patent is included in its entirety herein by reference.

In answer to these problems and disclosed herein is an improved vacuum transport that includes a segmented, rigid or solid articulated belt combined with a central vacuum plenum connected to each segment of the belt. By using a rigid segmented belt with a vacuum plenum connected to each segmented belt section, and driving the belt with a device positioned on the top side of the belt, the heretofore-mentioned drag friction is eliminated by reducing the force necessary to move belt with media thereon while simultaneously improving the motion quality of the move by driving the articulated rigid belt from the top side of the belt in a flat section.

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

Figure 1:
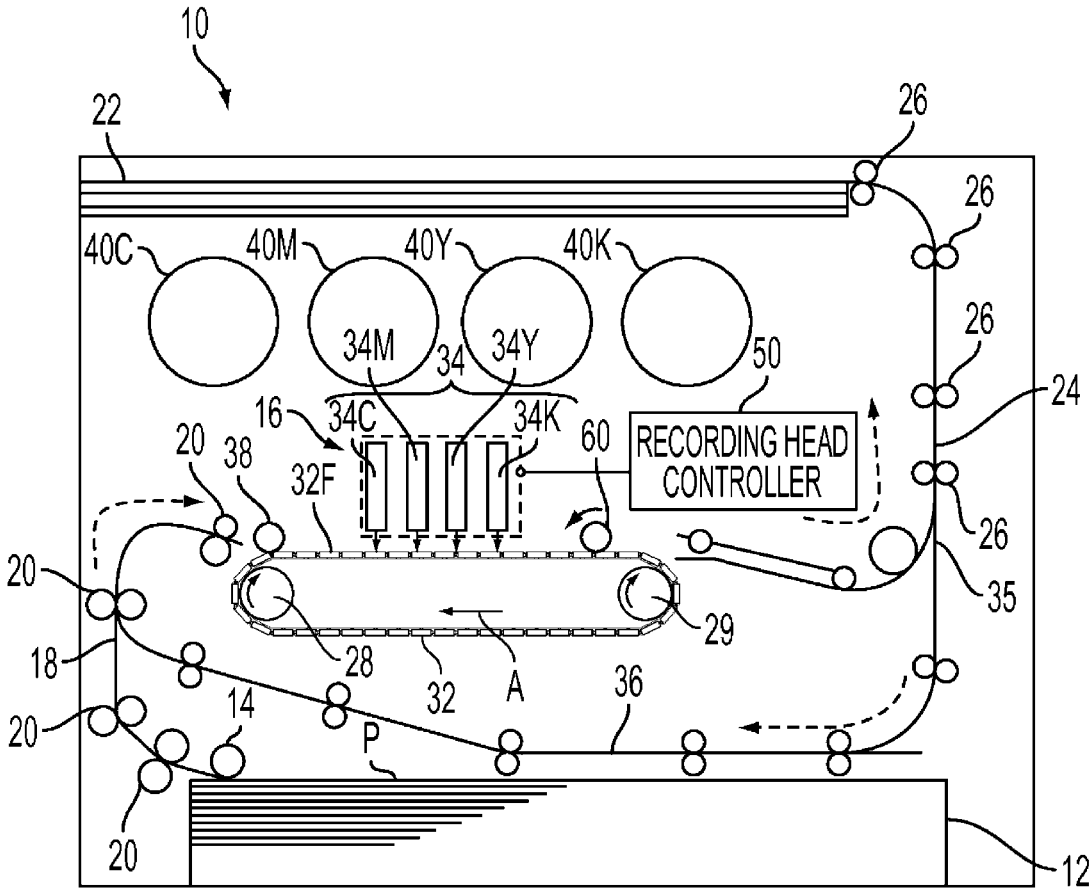
FIG. 1 is a schematic side view of an exemplary ink jet printer employing a vacuum transport and drive mechanism in accordance with the present disclosure.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

The disclosure will now be described by reference to a preferred embodiment ink jet printing apparatus that employs an improved interconnected rigid sectioned vacuum belt for transport and a high motion quality drive mechanism.

For a general understanding of the features of the disclosure, reference is made to the drawings. In the drawings, like reference numerals have been used throughout to identify identical elements.

Referring now to printer 10 in FIG. 1, the ink jet printer 10 is disposed with a media or paper supply cassette 12 in which paper or recording media P is accommodated. A feed roll 14 that pressingly contacts the leading end portion of the upper surface of the paper P and removes the paper P from the paper supply cassette 12 is disposed on the upper portion of the leading end side of the paper supply cassette 12.

The ink jet printer 10 includes a first conveyance path 18 that extends from the leading end portion of the paper supply of the paper supply cassette 12 and leads to a recording section 16, which conducts image recording on the paper P. Plural fist conveyance roller pairs 20 that constrain and convey the paper P to the recording section 16 are disposed on the first conveyance path 18.

The ink jet printer 10 also includes a second conveyance path 24 that extends upward from the recording section 16 and leads to a paper discharge tray 22, which accommodates the paper P on which an image has been recorded. Plural secondary roller pairs 26 that convey the paper P to the paper discharge 22 are disposed on the second conveyance path 24. An inverse conveyance path 36 for conducting two sided printing connects the second conveyance path 24 to the first conveyance path 18.

In operation, the paper P is removed from the paper supply cassette 12 by the feed roll 14, conveyed on the first conveyance path 18 by the plural conveyance roller pairs 20, and fed to the recording section 16, where image recording is conducted. When an image has been recorded on the paper P, the paper P is conveyed on the second conveyance path 24 by the plural conveyance roller pairs 26 and discharged into the paper discharge tray 22. When two-sided printing is to be conducted, an image is first recorded on one side of the paper P, and then the paper P is inverted at the junction 35 of paths 24 and 36 and is conveyed from the second conveyance path 24 to the first conveyance path 18 via the inverse conveyance paper path 36 and is again fed to the recording section 16, where image recording is conducted on the other side of the paper P. Thus, successive image recording is conducted.

Figure 2:
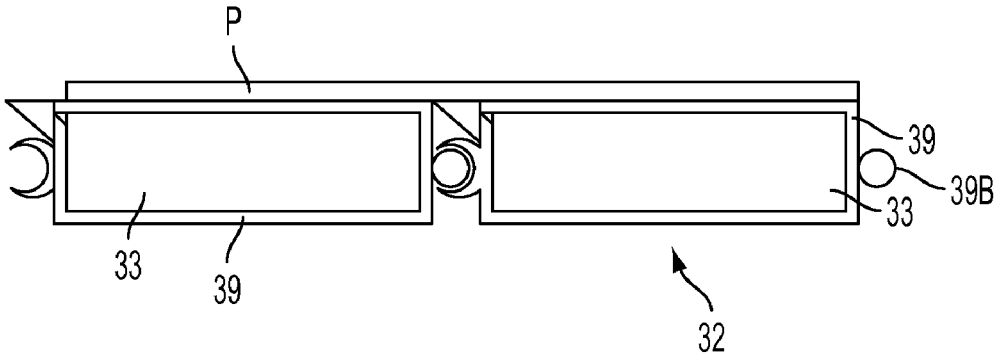
FIG. 2 is a schematic partial side view of the rigid segmented belt used in the vacuum transport shown in FIG. 1 with media thereon.

In accordance with the present disclosure, the recording section 16 includes an endless, interconnected, rigid, segmented or sectioned vacuum conveyor belt 32 that includes a number of small holes 33 shown in FIG. 2 therein. Vacuum belt 32 is wound around idler rollers 28 and 29 and driven preferably by a friction roller mechanism 60 positioned on top of a flat section of the vacuum belt downstream of the recording section 16 in the paper conveyance direction and on the outboard side of vacuum belt 32. The vacuum belt 32 is configured such that it is circulatingly driven by friction roll drive mechanism 60 in the direction of arrow A. A nip roller 38 that slidingly contacts the surface of the conveyor belt 32 is disposed on the upper portion of the idler roller 28.

An ink jet recording head 34 is disposed above the vacuum belt 32. The ink jet recording head 34 is configured to be long, such that its effective recording area is approximately equal to or greater than the process direction width of the paper P. The ink jet recording head 34 includes at least four inkjet recording heads 34C, 34M, 34Y and 34K, which respectively, correspond to the four colors cyan (C), magenta (M), yellow (Y) and black (K). The ink jet recording heads 34C, 34M, 34Y and 34K are disposed along the conveyance direction; thus, the ink jet recording head 34 can record a full-color image.

The ink jet recording head 34 faces a flat portion 32F of the conveyance vacuum belt 32, and this facing area serves as an ejection areas to which ink droplets are ejected from the ink jet recording head 34. The paper P conveyed on the first conveyance path 18 is retained and held flat to vacuum belt 32 by force of vacuum and sent to the ejection region, where the ink droplets corresponding to the image are ejected from the ink jet recording head 34 and onto the paper P in a state where the paper P faces the ink jet recording head 34.

Ink tanks 40C, 40M, 40Y and 40K, which supply the inks to the inkjet recording heads 34C, 34M, 34Y and 34K are disposed above the ink jet recording head 34.

The ink jet recording heads 34C, 34M, 34Y and 34K are connected to a recording head controller 50. The recording head controller 50 controls the ink jet recording head 34 by determining the ejection timing of the ink droplets and the ink ejection ports or nozzles to be used, in accordance with image information, and inputting a drive signal to the ink jet recording heads 34C, 34M, 34Y and 34K.

Figure 3:
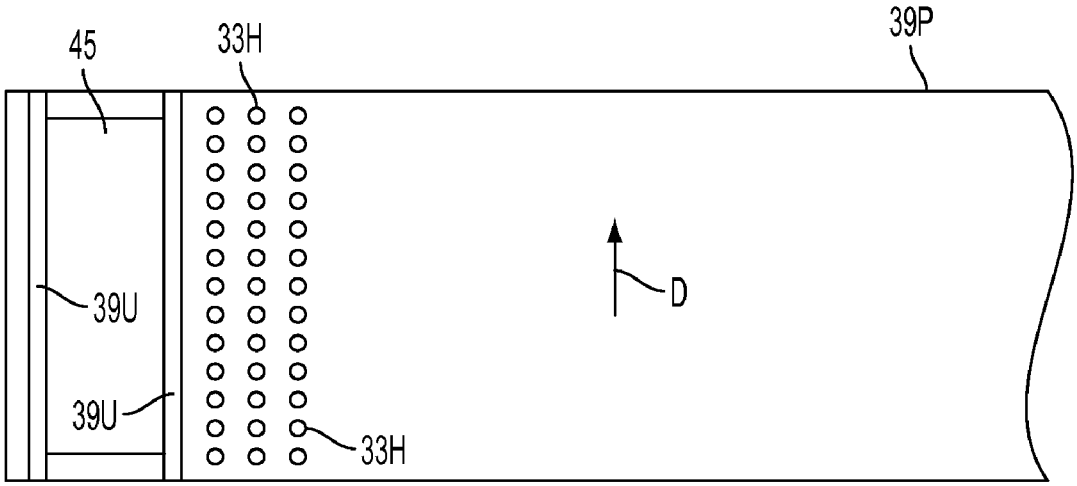
FIG. 3 is a schematic partial plan view of a segment of the rigid segmented belt used in the vacuum transport shown in FIG. 1.

In accordance with the present disclosure and shown in FIGS. 2-9, a vacuum transport comprises a vacuum transport belt 32 in FIG. 1 that includes segments 39 that have chambers 33 which allow, as shown in FIG. 2, individual access through outlet 45 to vacuum source 31 attached through vacuum plenum 30 to each segment 39 while the media is being driven. Each segment 39 of vacuum belt 32 traveling in the direction of arrow D is connected to another through the use of pivot balls 39B and has an air outlet 45 and holes 33H in an optimum hole pattern therein in segment plate 39P, as shown in FIG. 3, that communicate with the vacuum source 31 in order to apply vacuum pressure to paper P conveyed over the vacuum belt. In this way, constant vacuum hold down is attained by eliminating the separate belt and plenum employed heretofore in traditional vacuum transports while simultaneously reducing the blower requirements. Because the vacuum source in each segment is moving as the vacuum belt moves, the hold down force is self-contained and constant and does not add to the drag of the move. Thus, a steady and uniform hold down is obtained since there is no variation in vacuum pressure as the media moves along vacuum belt 32 and the vacuum pressure is the same throughout the area of the media. Preferably, the surface of each segment plate 39P has a roughness of approximately 100 μm.

Figure 4:
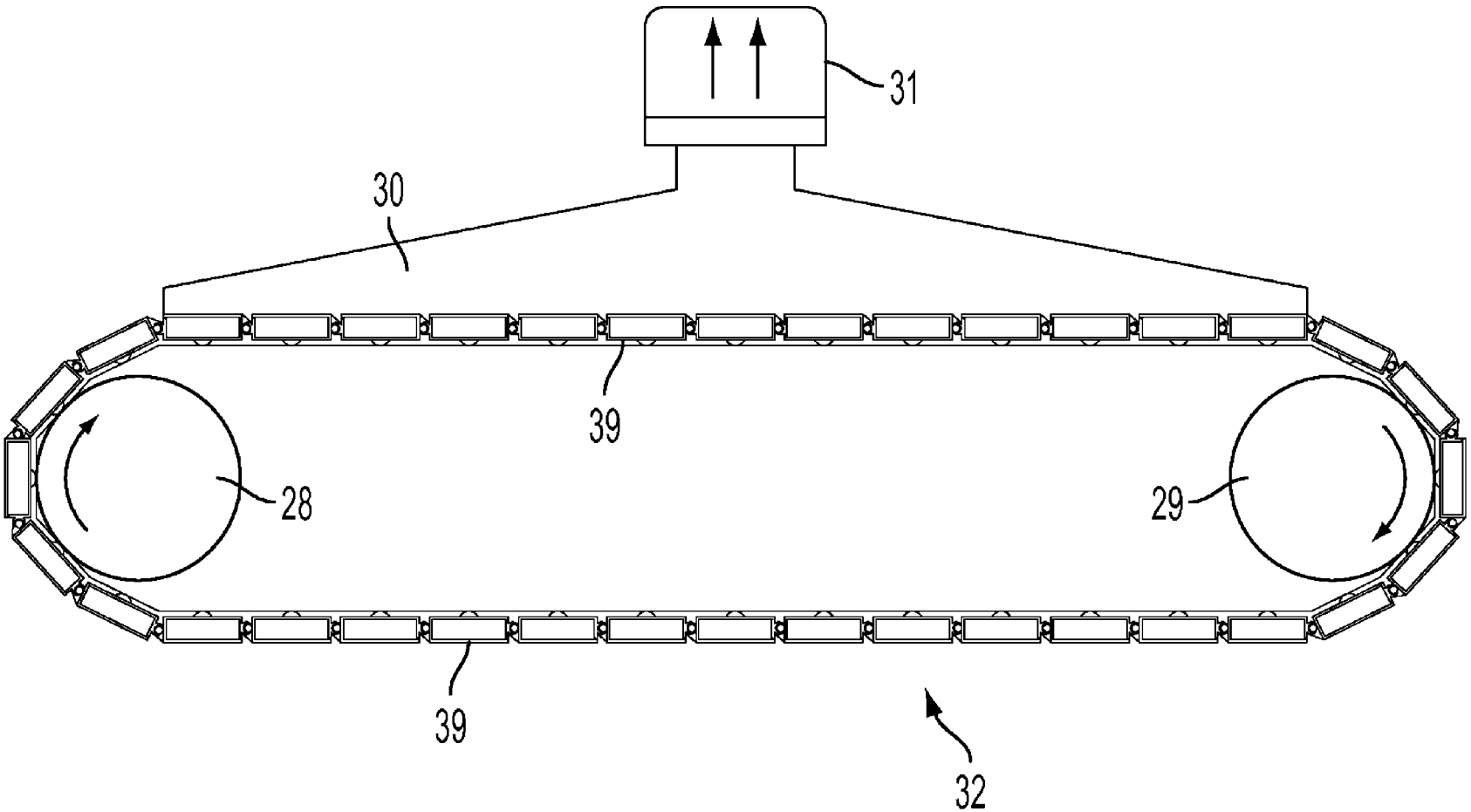
FIG. 4 is a schematic partial side view of the rigid segmented belt used in the vacuum transport shown in FIG. 1 and a vacuum plenum that supplies vacuum pressure to each segment of the belt.
Figure 5:
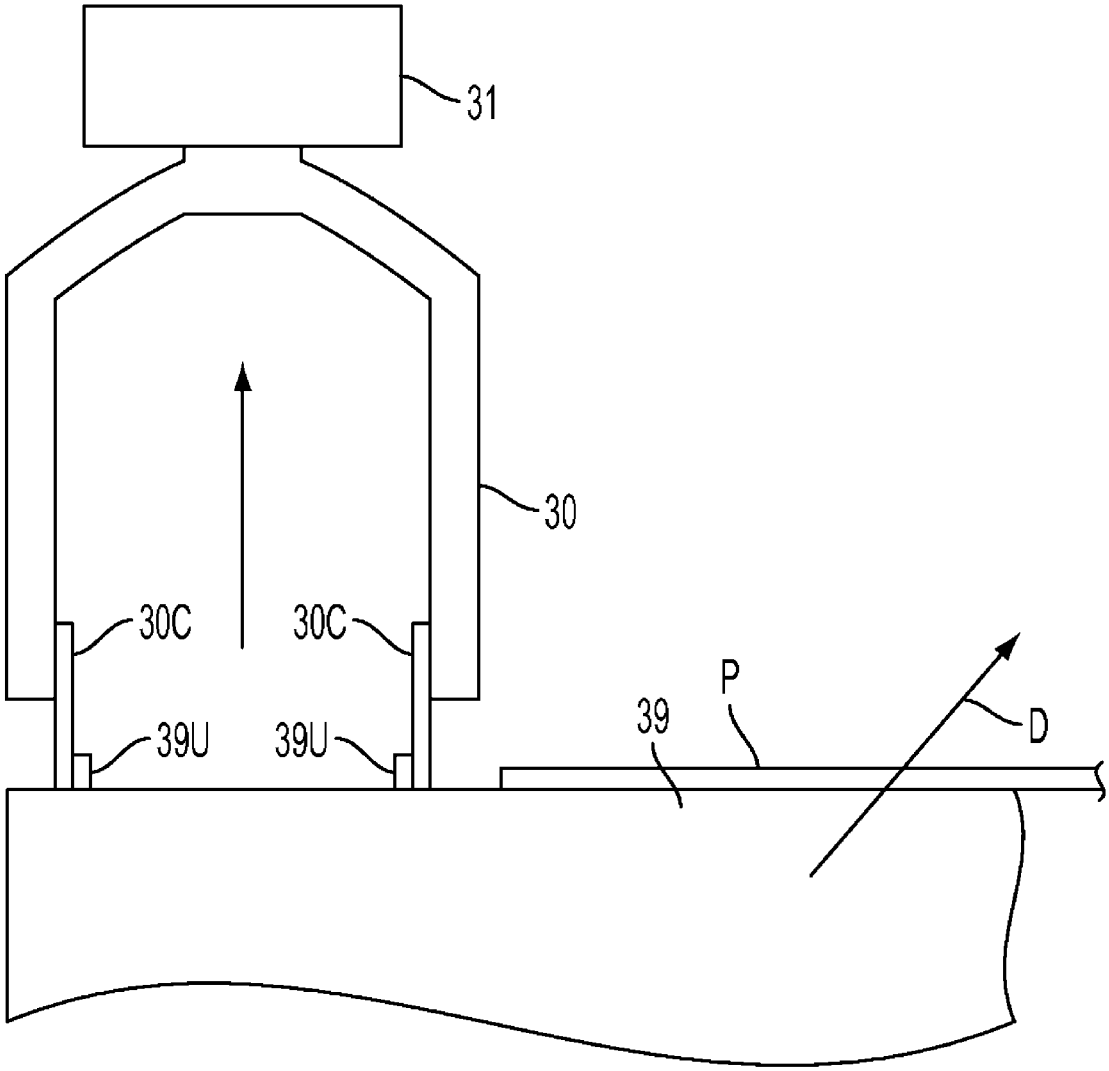
FIG. 5 is a schematic partial side view showing the vacuum plenum interface too a segment of the rigid segmented belt and vacuum plenum used in the vacuum transport shown in FIG. 4.

As shown in FIG. 4, a vacuum plenum 30 is positioned over the inboard side of belt 32 and adapted to apply vacuum pressure through vacuum source 31 to the holes 33 in vacuum plate 32P in order to attach sheet media or paper P to the vacuum belt during recording by the recording section 16. In order to obtain a tight fit for vacuum purposes between air outlet 45 shown in FIG. 3 and vacuum plenum 30, closure members 30C of vacuum plenum 30 in FIG. 5 are adapted to fit against upstanding members 39U that project upwardly from and surround air outlet 45 in vacuum plate 32P.

High motion quality drive mechanisms for segmented, rigid plate, vacuum transport 32 are shown in FIGS. 6-9 that address 'chordal action' that is inherent in segmented chain drives by driving vacuum belt 32 from the top side over a flat section of the vacuum transport and thereby avoiding the poor motion quality that results when such rigid, segmented belts are driven by either of the transport rollers 28, 29. The drive mechanisms will transfer a constant linear velocity to vacuum belt 32 and allow the revolutions-per-minute (RPM) of idler rolls 28 and 29 of FIG. 1 to vary as oppose to the traditional method of driving the vacuum belt with one drive roll and an oppositely positioned idler roll with a constant RPM and allowing the vacuum belt to have a non-uniform velocity due to the cogging 'chordal action' of the rigid segments rotating around idler rollers 28 and 29.

Figure 6:
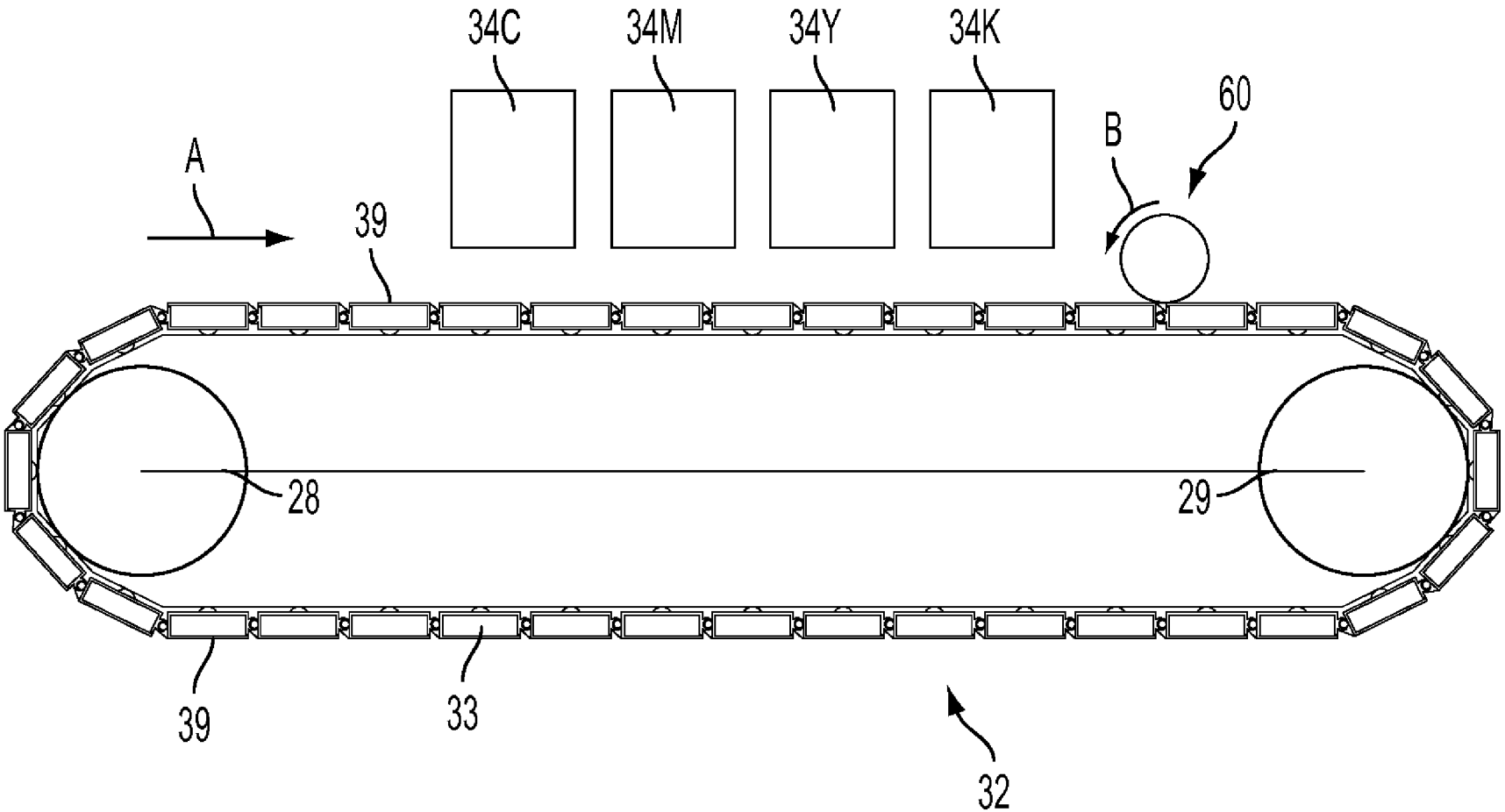
FIG. 6 is a schematic side view of the rigid segmented belt used in the vacuum transport shown in FIG. 1 being driven by a top drive friction roll.
Figure 7:
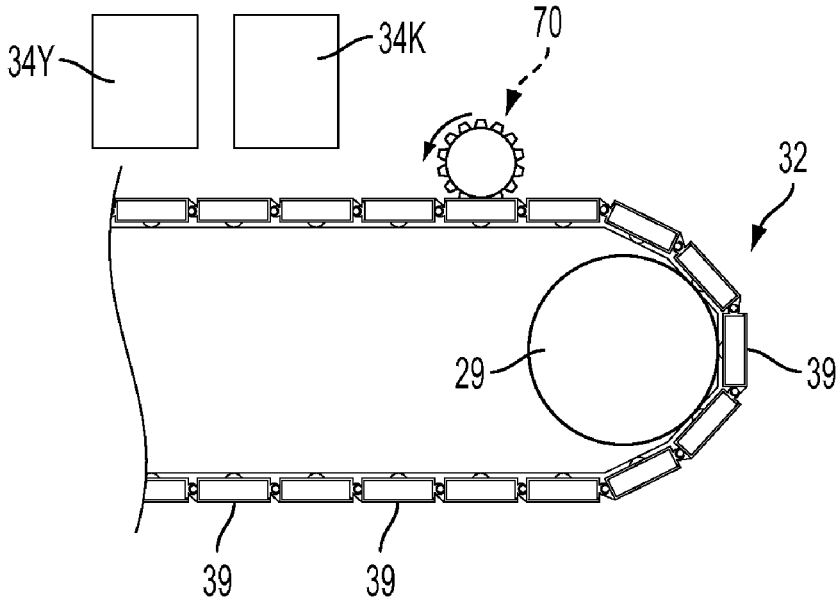
FIG. 7 is a schematic partial side view of the rigid segmented belt used in the vacuum transport shown in FIG. 1 being driven by a top drive gear mechanism.
Figure 8:
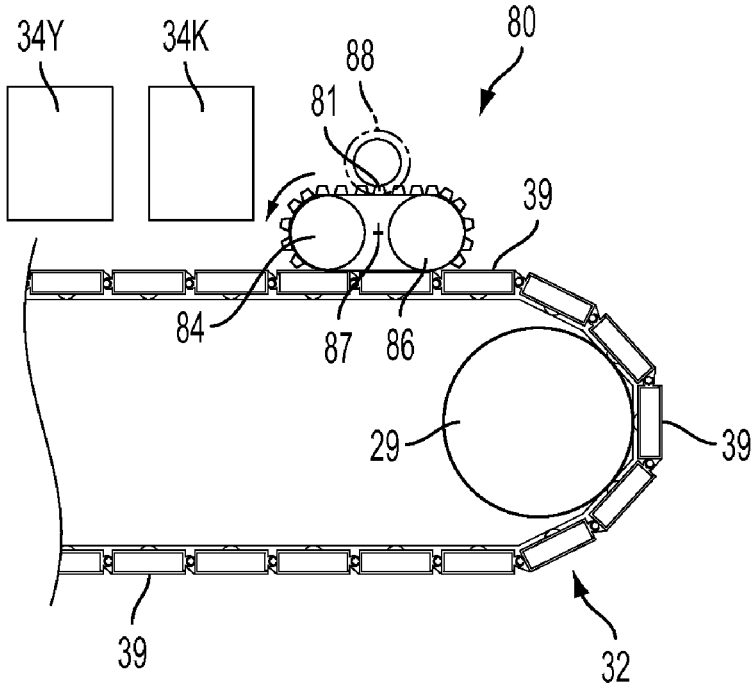
FIG. 8 is a schematic partial side view of the rigid segmented belt used in the vacuum transport shown in FIG. 1 being driven by a top drive belt mechanism with external teeth.
Figure 9:
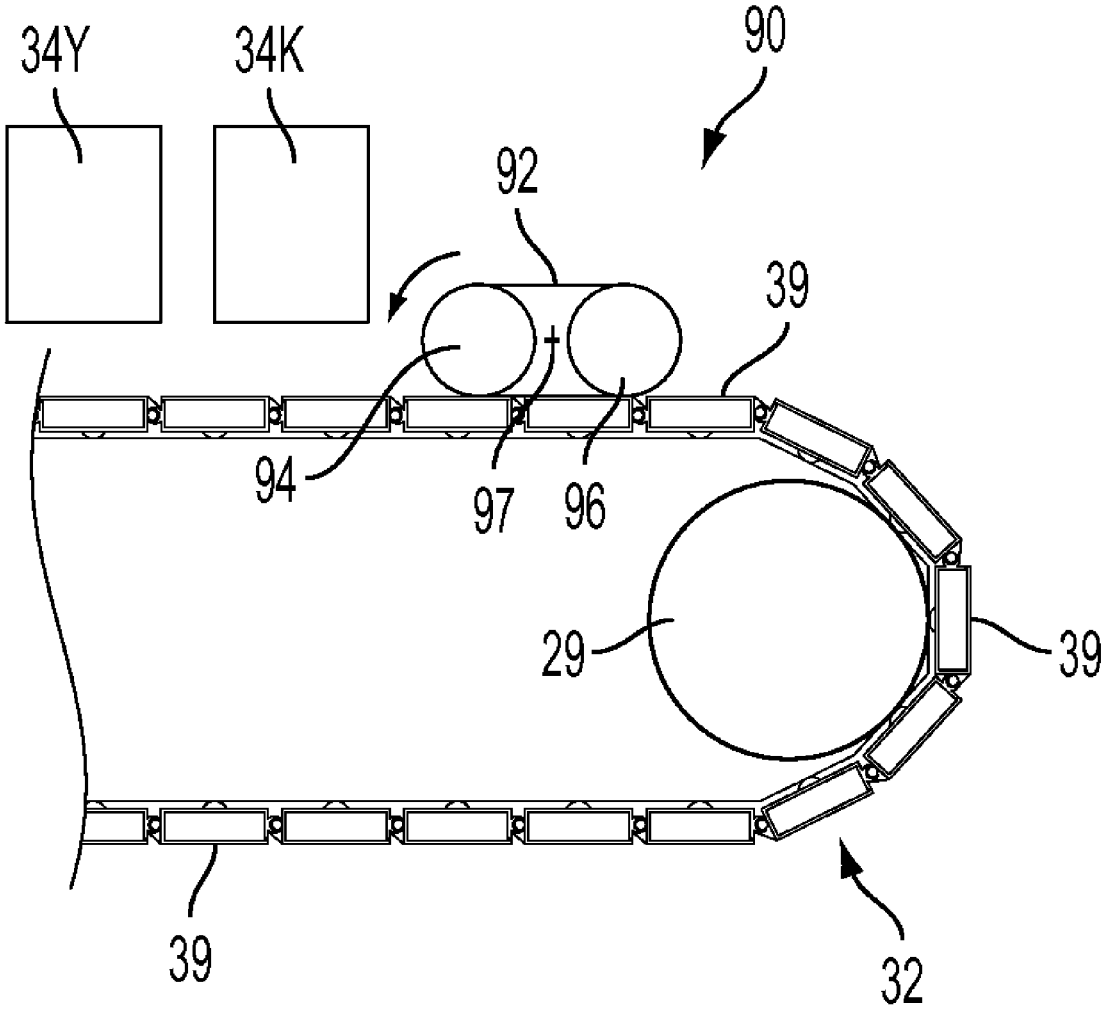
FIG. 9 is a schematic partial side view of the rigid segmented belt used in the vacuum transport shown in FIG. 1 being driven by a top drive friction belt mechanism.

In FIG. 6, a constant linear velocity to rigid vacuum belt 32 is applied by a friction roll drive mechanism 60 that includes a friction roll position on top of vacuum belt 32 outside of the media path and rotated in the direction of arrow B that allows the RPM of idler roller rollers 28 and 29 to vary which results in high quality images exiting the recording section 16. In another top drive embodiment of FIG. 7, a gear mechanism 70 is shown that is more positive than a friction wheel. It should be understood that this gear drive mechanism requires rack teeth in the segments of vacuum belt 32. Yet another and preferable embodiment of a high motion quality top drive mechanism in accordance with the present disclosure is shown in FIG. 8 and comprises an externally toothed timing belt mechanism 80 that includes an inverted timing belt 81 entrained around idler rolls 84 and 86 and could be driven by drive pulley 88 or other suitable means. Use of the timing belt mechanism requires grooves similar to those on a timing belt pulley of infinite radius formed in the rigid vacuum belt and the segment length needs to be a multiple of the timing belt pitch for positive drive and uniform velocity. Offsetting the timing belt mechanism pivot point 87 is also useful in maintaining a constant engagement force along the toothed belt to segmented plate interface. In FIG. 9, another embodiment of a high motion quality top drive mechanism in accordance with the present disclosure is shown that includes a conventional friction belt drive mechanism 90 comprising a friction belt 92 positioned on top of and in contact with rigid, flat, segmented belt 32. Friction belt 92 surrounds drive roll 96 and idler roll 94 while being gimbaled with the pivot point 97 offset to balance the load on both ends of belt 92.

Alternatively, vacuum plenum 30 could be positioned over the outboard side of vacuum belt 32 or within vacuum belt 32, if desired. Also, the high motion quality top drive mechanism of the present disclosure while preferably positioned to drive the vacuum belt from the outboard side of the belt will work equally well if placed on the inboard side of the belt.

It should now be understood that a vacuum transport system has been disclosed that promotes depth of focus control between a media print plane and ink jet heads of about ±0.1 mm and comprises an interconnected, rigid, sectioned vacuum belt for media transport through an imaging zone of an ink jet printer. Each section or segment of the vacuum belt has its own vacuum plenum and source of vacuum. The vacuum belt is driven by a drive mechanism that is positioned on top of one of the segments of the vacuum belt in an area where the segments are in a horizontal plane in order to eliminate 'chordal effects' and thereby remove image quality as a concern. While the disclosed vacuum transport system is shown used for transporting cut sheet media, it could also be used, for example, with a larger scale corrugated ink jet printing system.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A printing apparatus, comprising:

an imaging apparatus for forming an image on an image receiving media;

a sheet feeder for supplying and feeding the image receiving media toward said imaging apparatus;

a vacuum transport system for conveying said image receiving media past an imaging zone of said imaging apparatus, said vacuum transport system including a rigid, flat, interconnected vacuum belt comprising a series of individual segments entrained around spaced idler rolls with a portion of said individual segments of said vacuum belt being positioned in a horizontal plane between said spaced idler rolls; and a high motion quality drive member positioned upstream of one of said spaced idle rolls and in said horizontal plane downstream of said imaging apparatus and on top of and in contact with an exterior portion of said vacuum belt, said drive member being adapted to drive said vacuum belt at a constant linear velocity and thereby control the motion of said vacuum belt and ensure high quality images on said image receiving media.

2. The printing apparatus of claim 1, wherein each segment of said vacuum belt includes a series of holes in a surface thereof adjacent said image receiving media.

3. The printing apparatus of claim 2, wherein each segment of said vacuum belt includes an air outlet connected to a central vacuum source.

4. The printing apparatus of claim 3, wherein said high motion quality drive member is a friction roll mechanism.

5. The printing apparatus of claim 3, wherein said high motion quality drive member is a gear drive mechanism.

6. The printing apparatus of claim 3, wherein said high motion quality drive member is a friction belt mechanism.

7. The printing apparatus of claim 3, wherein said high motion quality drive member is an externally toothed belt mechanism.

8. The printing apparatus of claim 2, wherein said high motion quality drive member is positioned outside a feed path of said image receiving media.

9. The printing apparatus of claim 8, wherein each of said series of individual segments includes a plate member having a surface roughness and a hole pattern such that constant vacuum hold down pressure is applied to image receiving media being conveyed by the segments.

10. An ink jet recording apparatus that conducts image recording by ejecting ink onto a recording medium conveyed past a recording section, the ink jet recording apparatus comprising:

a vacuum transport system for conveying said recording medium past said recording section, said vacuum transport system including a rigid, flat, interconnected vacuum belt including a portion positioned in a horizontal plane beneath said recording section and comprising a series of individual segments entrained around spaced idler rolls; and a high motion quality drive member positioned on top of and in contact with a flat portion of said vacuum belt and positioned in-line with and downstream of said recording section and in said horizontal plane and adapted to pull said vacuum belt at a constant linear velocity to thereby control the motion of said vacuum belt and ensure high quality images on said recording medium.

11. The ink jet recording apparatus of claim 10, wherein each segment of said vacuum belt includes a series of holes in a surface thereof adjacent said image receiving media.

12. The ink jet recording apparatus of claim 11, wherein each segment of said vacuum belt includes an air outlet connected to a central vacuum source.

13. The ink jet recording apparatus of claim 12, wherein said high motion quality drive member is a friction roll mechanism.

14. The ink jet recording apparatus of claim 12, wherein said high motion quality drive member is a gear drive mechanism.

15. The ink jet recording apparatus of claim 12, wherein said high motion quality drive member is a friction belt mechanism.

16. The ink jet recording apparatus of claim 12, wherein said high motion quality drive member is an externally toothed belt mechanism.

17. The ink jet recording apparatus of claim 11, wherein said high motion quality drive member is positioned outside a feed path of said recording medium.

18. The ink jet recording apparatus of claim 17, wherein said recording section includes an ink jet module.

* * * * *